US005416333A

United States Patent [19]

Greenspan

[11] Patent Number: 5,416,333

[45] Date of Patent: May 16, 1995

[54] MEDIUM DENSITY HYDROGENOUS MATERIALS FOR SHIELDING AGAINST NUCLEAR RADIATION

[76] Inventor: Ehud Greenspan, 4 Captain Dr. #407, Emeryville, Calif. 94608

[21] Appl. No.: 72,399

[22] Filed: Jun. 3, 1993

[51] Int. Cl.[6] ..... G21F 1/00

[52] U.S. Cl. ..... 250/515.1; 250/518.1

[58] Field of Search ..... 250/505.1, 515.1, 516.1, 250/518.1, 519.1

[56] References Cited

U.S. PATENT DOCUMENTS

| | | | |
|---|---|---|---|
| 4,123,392 | 10/1978 | Hall et al. | 252/478 |
| 4,242,245 | 12/1980 | Allison, III | 260/27 BB |
| 4,610,893 | 9/1986 | Eriksson et al. | 250/518.1 |
| 4,938,233 | 7/1990 | Orrison | 250/519.1 |
| 5,245,195 | 9/1993 | Shah et al. | 250/519.1 |
| 5,262,463 | 11/1993 | Berzen | 250/518.1 |

OTHER PUBLICATIONS

R. G. Jaeger, ed., "Engineering Compendium on Radiation Shielding" vol. II "Shielding Materials", Springer-Verlag, N.Y. 1975.

E. Greenspan, "High Effectiveness Shielding Materials and Optimal Shield Design", Journal of Testing a Evaluation, vol. 20, No. 1, pp. 71–77, Jan. 1992.

Y. Karni et al. "Effective Materials and Optimal Design for Radiation Shields," Proc. Amer. Nucl. Soc. on New Horizons in Radiation Shielding, Pasca, Wash., Apr. 26–May 1, 1992, pp. 154–161.

Reactor Experiments, Inc. catalog 24.

Bisco Products Technical Data Sheets.

*Primary Examiner*—Jack I. Berman

*Assistant Examiner*—James Beyer

[57] ABSTRACT

This invention relates to compositions, methods of production and uses of materials for shielding against nuclear radiation. These materials are made of a low density solid hydrogenous material which binds a powder of medium density materials. They are particularly effective for shielding against fission and high energy neutrons, as well as against a combined radiation of neutrons and photons.

23 Claims, No Drawings

MEDIUM DENSITY HYDROGENOUS MATERIALS FOR SHIELDING AGAINST NUCLEAR RADIATION

BACKGROUND OF THE INVENTION

1. Field of the Invention

This invention relates generally to materials for shielding against nuclear radiation and more particularly, against neutrons and gamma rays (also referred to as photons).

2. Description of Related Art

The need to shield against nuclear radiation for protection of personnel and instruments is encountered in a wide variety of installations and activities. These installations include but are not limited to fission reactors, fusion facilities, and particle accelerators. The activities include, but are not limited to research, medical applications, oil logging, as well as transport and storage of radioactive materials.

Shielding against neutrons usually involves the following processes: (a) Slowing-down of the neutrons; that is, reducing the neutrons' kinetic energy. This is achieved by letting the neutrons undergo elastic, and sometimes also inelastic scattering collisions with the nuclei of atoms of different materials which constitute the shield. (b) Absorption of the neutrons. In general, as the neutron energy becomes lower, the probability increases for the neutron to be absorbed by the nuclei of the shield constituents, while traversing a given distance in the shield. Most of the neutron absorption reactions and neutron inelastic scattering collisions give off photons, usually referred to as secondary photons (to distinguish them from photons which do not originate from neutron interactions within the shield). (c) Absorption of the secondary photons.

It is well known that hydrogen is very effective for the slowing-down of neutrons. This is due to the relatively large fraction of its energy that a neutron loses, on the average, when it collides (elastically) with a proton—the nucleus of an hydrogen atom. Hence, hydrogen is one of the major constituents of many materials used for neutron shielding, i.e., for shielding against neutron radiation. Henceforth, materials containing a substantial amount of hydrogen will be referred to as hydrogenous materials.

Most of the materials used for radiation shielding applications are in the solid state. Among the most effective solid hydrogenous materials for shielding against neutron radiation are organic polymers, such as plastics and rubbers. Examples include, but are not limited to hydrocarbon plastics (such as polyethylene, polypropylene and polystyrene); natural and synthetic rubber (such as silicone rubber); and other plastics or resins containing atoms in addition to hydrogen and carbon (such as acrylic, polyester, polyurethanes and vinyl resins). The high effectiveness of these organic polymers for shielding against neutrons is due to the large concentration of hydrogen atoms in these materials. A common measure of the concentration of hydrogen is the hydrogen atomic density—the number of hydrogen atoms in a cubic centimeter of the given material.

One of the organic polymers most widely used for radiation shielding is polyethylene. Its hydrogen atomic density is nearly $8\times10^{22}$ atoms/cm$^3$; this is higher than the hydrogen density in most of the other organic polymers. It is about 20% higher than the atomic density of hydrogen in water, when both are at room temperature. Henceforth we shall explicitly refer to polyethylene; it is to represent other hydrogenous materials as well.

As a result of its high hydrogen atomic density, polyethylene is considered to be one of the most effective materials for the attenuation of neutrons having an energy of few MeV or lower. One measure of the neutron attenuation ability of a shielding material is the reduction in the energy the neutrons leaking out from a shield of a given thickness will deposit per unit weight of a biological tissue per unit time—referred to in the profession as "dose rate". The neutron attenuation ability of a shield is to be distinguished from "neutron shielding ability" which is a measure of the ability of the shield to reduce the combined contribution to the dose rate of the neutrons and their secondary photons. Similarly, the photon attenuation ability of a shielding material will be measured by the ability of a given thickness of this material to reduce the contribution of a given source of photons to the dose rate behind the shield. As the probability for neutron-producing photon reactions is very small, the term "photon shielding ability" is practically identical to the photon attenuation ability.

One drawback of pure polyethylene as a shielding material against neutrons is that the slowed-down neutrons which are absorbed by the hydrogen of the polyethylene generate a significant source of 2.2 MeV photons (i.e., photons having an energy of 2.2 Million electron Volts). The neutron shielding ability of polyethylene can be improved if a good neutron absorbing material is added to it so as to reduce the production probability of energetic secondary photons. The neutron absorbing material in common use is boron. Thus, for example, one of the most commonly used polyethylene based commercial shielding materials against neutron sources is borated polyethylene. One example of such a commercial shielding material is the 5% Boron-Polyethylene being offered by Reactor Experiments, Inc. (to be referred to as R/X)—R/X Catalog number 201. (This catalog can be obtained from Reactor Experiments, Inc., 1275 Hammerwood Ave., Sunnyvale, Calif. 94089-2231).

Another drawback of polyethylene as a shielding material is that it has a relatively low specific weight, also referred to as density. In general, the higher the density of a material, the better is its shielding ability against energetic photons (defined, for example, as photons having energy greater than 1 MeV) for a given shield thickness. In other words, given two shields of identical geometry, the shield made of the higher density material will, in general, attenuate the energetic (and more difficult to attenuate) photons better than the shield made of the lower density material. The specific weight or density of a material is commonly measured by the number of grams of this material which occupy one cubic centimeter. A typical density of polyethylene is 0.92 g/cm$^3$. For comparison, a typical density of ordinary concrete is 2.3 g/cm$^3$, of stainless steel is 7.8 g/cm$^3$, of lead is 11.3 g/cm$^3$, and of tungsten is up to 19.2 g/cm$^3$.

Due to its relatively low density, the neutron shielding ability of pure polyethylene and even of borated polyethylene is not very good; the relatively energetic (2.2 MeV) secondary photons are not well attenuated by the polyethylene. Thus, the secondary photon contribution to the dose rate beyond a pure polyethylene shield can far exceed the contribution of the neutrons to the dose rate. Similarly, pure or borated polyethylene are not, by themselves, good shielding materials for applications in which the shield is exposed to photons as well as to neutrons. In other words, pure and borated polyethylene (and similar low density hydrogenous materials) have a superb attenuation ability for neutrons having energies up to a few MeV, but poor neutron shielding ability and poor photon shielding ability.

Consequently, when shielding against neutron sources, or combined neutron and photon sources, it is customary to use a two-layer shield—one layer made of polyethylene and the other layer made of a higher density material, such as concrete or lead. It is also customary to use a single layer shield made of a material which features a suitable combination of hydrogen atomic density and specific weight.

One approach to the production of hydrogenous materials having densities higher than polyethylene is to add to the polyethylene a higher density constituent. A common additive used for improving the photon attenuation ability of polyethylene is lead. Thus, for example, the polyethylene based commercial shielding materials against a combined radiation of neutrons and photons being offered by Reactor Experiments, Inc. is Poly-Boron Lead; R/X Catalog Number 202. The boron is added for the purpose of absorbing the slowed-down neutrons and, thus, suppressing the secondary photon source.

One drawback of lead loaded borated polyethylene is that its attenuation ability for fission neutrons and for lower energy neutrons is inferior to that of pure and borated polyethylene. Another drawback of lead loaded shielding materials is that lead is a chemically toxic element, and its use is becoming more and more restricted and complicated. Yet another drawback of lead loaded borated polyethylene is that lead is more expensive per unit volume than polyethylene. Thus, the price of R/X material No. 202 is more than 3 times higher than the price of an equal volume of R/X material No. 201.

A completely different approach to the design of shields against a combined radiation of neutrons and photons is to use concretes. The composition and density of concretes used for radiation shielding can vary significantly from application to application. Information on different concretes can be found in Sections 9.1.12 and 9.1.19 of Volume II (entitled "Shielding Materials") of the "Engineering Compendium on Radiation Shielding", R. G. Jaeger, Editor-in-Chief, Springer-Verlag, New-York (1975).

The density of conventional concretes is, typically, 2.3 g/cm$^3$. The atomic density of hydrogen in conventional concretes is, typically, $1.5\times10^{22}$ atoms/cm$^3$. This is only about 20% of the hydrogen atomic density in polyethylene. Due to their relatively low hydrogen atomic density, conventional concretes do not make good neutron shields. For applications in which shielding against neutrons is an important design goal, and a concrete type material is desirable, it is possible to use special, more expensive concretes which can hold a larger amount of water than ordinary concretes. Examples of such concretes can be found in the above identified Volume II of the "Engineering Compendium on Radiation Shielding".

A drawback of the high hydrogen density concretes is that their hydrogen atomic density, although higher than that of ordinary concretes, is still much lower than in high hydrogen density hydrogenous materials such as polyethylene. Other types of commercially available shielding materials which can be cast similar to concretes, but which have higher hydrogen atomic density than concretes, are made of small particles or beads of some plastic material mixed with a cementitious material. One example of such a shielding material is the so called POLY/CAST, material No. 259 in the catalog of R/X. It uses a cementitious material to bond the beads of polyethylene. Hall and Peterson, in U.S. Pat. No. 4,123,392, entitled "Non-Combustible Nuclear Radiation Shields with High Hydrogen Content," suggest using either Portland cement, wall plaster, plaster of Paris, silica gel or clay for bonding many different types of hydrogenous materials. The motivation of Hall and Peterson to bond hydrogenous materials by such cementitious materials was to reduce the fire hazard of the hydrogenous materials.

One drawback of POLY/CAST is that it has a low density of 1.15 g/cm$^3$; this is only slightly higher than the 0.92 to 0.96 g/cm$^3$ of pure polyethylene. Thus, it will not provide an effective shielding against photons. Another drawback of POLY/CAST is that it can be chipped off easily and can develop cracks. Thus, it is not being used for structural or stand-alone components. Rather, it is usually cast into a mold of some kind, such as a stainless steel container. Still another drawback of POLY/CAST is that it is not machinable. Yet another disadvantage of POLY/CAST is that it is not reusable. The latter two drawbacks also apply to concretes of all kinds.

The non-reusability of POLY/CAST is due to the fact that it can not be reshaped as easily as polyethylene or polyethylene bonded materials. One way to reshape the latter is by melting and recasting them—essentially repeating the original process of their fabrication. This is because bonding by polyethylene is physical; it can be obtained, for example, by mixing molten polyethylene with the particles to be bonded, and letting the polyethylene solidify. On the other hand, bonding by cementitious materials such as Portland cement and plasters of various types is based on chemical processes—chemical reactions between the cement constituents and water.

An additional drawback of cementitious materials (including concretes and POLY/CAST) is that the amount of water that they bond when being cast tends to decrease with time. This implies that the atomic density of the hydrogen contained in these materials may decrease with time. This will impair the neutron shielding ability of these shielding materials.

It is well known to those skilled in the art that a proper combination of hydrogenous and good inelastically scattering materials can slow down and, therefore, attenuate high energy neutrons better than either pure polyethylene or the inelastic scattering material by themselves. Inelastically scattering materials are materials with which high energy neutrons can undergo collision reactions which result in a conversion of part of the colliding neutron kinetic energy to the internal energy of the nucleus of the material with which the neutron collided. Inelastic scattering by materials such as tungsten, lead and even iron is known to be a more effective mechanism than elastic scattering by hydrogen for slowing down neutrons having energies higher than a few MeV.

It is also well known to those skilled in the art that the higher the neutron energy, the larger becomes the inelastic scattering contribution to the neutron slowing down. Thus, whereas the lead borated polyethylene of R/X catalog number 202 is less effective than pure or borated polyethylene for the attenuation of fission-born neutrons, it is more effective than pure or borated polyethylene for the attenuation of fusion-born neutrons. Herein "fission-born neutrons" (or "fission neutrons") are neutrons which are emitted from fission reactions; their average birth energy is approximately 2 MeV. "Fusion-born neutrons" (or "fusion neutrons") are neutrons which are emitted from the fusion of one deuterium nucleus and one tritium nucleus. These neutrons' birth energy is close to 14 MeV. Deuterium and tritium are isotopes of hydrogen; they differ from protium—the most abundant hydrogen isotope—by the number of neutrons in their nuclei: 1 and 2 neutrons in, respectively, the nuclei of deuterium and tritium, versus no neutron in the nucleus of the protium. Henceforth, the term "high energy neutrons" will refer to neutron from a source with average energy that is higher than the average energy of fission neutrons. It includes, but is not limited to fusion neutrons. The term "fission-like neutrons" will refer to neutrons from a source with average energy that is equal to or lower than 2 MeV. The term "neutrons" will refer to neutrons of any energy.

With few exceptions, the lower the atomic mass number of the element, the less effective the element is as an inelastic scatterer. Thus, materials such as magnesium, silicon, calcium, fluorine and oxygen are usually considered to be poor inelastic scatterers as well as poor elastic scatterers. Consequently, the constituents of concretes and cementitious materials other than water (which is added to harden them) are considered poor inelastic scatterers as well as poor elastic scatterers of neutrons. There is no known teaching in the background art that a combination of such materials with polyethylene or another hydrogenous material can provide a better neutron attenuation ability that the hydrogenous material by itself.

SUMMARY OF THE INVENTION

It is an object of this invention to provide materials having improved attenuation ability against high energy neutrons.

It is another object of this invention to provide materials having improved shielding ability against neutrons.

It is yet another object of this invention to provide materials having improved shielding ability against a combined radiation of neutrons and photons.

According to the principles of this invention, novel mixes of hydrogenous and non-hydrogenous materials are used to make improved shielding materials against neutrons and against a combined radiation of neutrons and photons. The hydrogenous material is used to physically bond medium density environmentally benign materials to provide improved shielding against neutrons and against a combined radiation of neutrons and photons.

Whereas the manufacturing, handling and using of the leaded hydrogenous shielding materials pose a health hazard, the shielding materials of this invention use environmentally benign constituents. Moreover, the novel shielding materials of this invention are significantly more effective than leaded hydrogenous materials for shielding against high energy neutrons. In addition, the novel shielding materials of this invention are significantly less expensive than leaded polyethylene having comparable shielding ability.

Whereas medium density materials are the major constituents of cementitious materials which bond small particles of polyethylene in shielding materials such as POLY/CAST, the shielding materials of this invention use an hydrogenous material, such as polyethylene, to bond small particles of the selected medium density materials. As these medium density materials bonded by the hydrogenous material are in the form of small particles, the new shielding materials of this invention will be referred to, henceforth, as "powder loaded hydrogenous materials". In the powder loaded hydrogenous materials of this invention the hydrogenous materials form a continuous phase, whereas the medium density materials are in a discontinuous phase. The conventional shielding materials made of small particles, or beads of an hydrogenous plastic material bonded by a cementitious material will be referred to as "cemented plastics".

One advantage of the powder loaded hydrogenous materials is that they can use a wider selection of medium density constituents and many more combinations of these constituents than cemented plastics. This unique feature of the novel materials of this invention is due to the fact that the medium density constituents have no structural function in the novel materials, but have to have bonding ability in the conventional cementitious plastics. One consequence of this advantage is that the powder loaded hydrogenous materials can use medium density materials which have better neutron attenuation and shielding ability than the state-of-the-art cemented plastics. Another consequence of this advantage is that it provides the shield designer more flexibility in optimizing the shield composition to specific applications. Yet another consequence of this advantage is that the powder loaded hydrogenous materials can be made to have a lower concentration of undesirable impurities than the cemented plastics. Still another consequence of this advantage is that the powder loaded hydrogenous materials of this invention can be made to have a higher specific weight than the cemented plastics and, hence, to have a better shielding ability against photons.

Another advantage of the powder loaded hydrogenous materials is that the attenuation ability they provide even against fission-like neutrons is better than the attenuation provided by even the powder-free plastic materials (which have a higher hydrogen atomic density). This finding is believed to be nonobvious to persons skilled in the relevant art; it is neither taught nor suggested in the known background art. One implication of this finding is that the new shielding materials can provide a desirable shielding performance for a smaller shield thickness and/or for a lower shield cost.

Yet another advantage of the powder loaded plastic materials is that they can be self supporting whereas cemented plastics with high volume fraction of the plastic material have to be supported by the walls of a container or other structures.

An additional advantage of the powder loaded plastic materials is that they do not easily chip or crack as do the cemented plastics.

Still another advantage of the powder loaded hydrogenous materials is that their hydrogen atomic density and specific weight do not vary with time, whereas the hydrogen atomic density and specific weight of the cemented plastics can be time dependent.

One more advantage of the powder loaded hydrogenous materials is that they can be refabricated to have a different shape and a different composition. In contrast, it is not practical to reshape or change the composition of cemented plastics, once they have been casted.

In addition, powder loaded hydrogenous materials can operate at higher temperatures than cemented plastics.

DETAILED DESCRIPTION

As noted above, the invention involves a certain type of discontinuous phase dispersed in and bonded by a continuous phase in a way that improves shielding against radiation sources of neutrons and photons.

The continuous phase in the materials of this invention consists of a solid hydrogenous material. Herein, "solid hydrogenous material" refers to a material which is in a solid state at the temperature of its application, and the hydrogen atomic density of which is at least one-third of, and preferably, higher than that of water at standard temperature and pressure. Many different solid hydrogenous materials can be used for the shielding materials of this invention. These include, but are not limited to different plastics and rubbers such as hydrocarbons, hydrocarbon plastics (such as polyethylene, polypropylene and polystyrene), natural and synthetic rubbers (such as silicone rubber) and other plastics or resins containing atoms in addition to hydrogen and carbon. Desirable characteristics of these hydrogenous materials include high atomic density of hydrogen, and good physical structural properties at the temperature range in which they are intended to operate. In the preferred embodiment of this invention, polyethylene is used as the hydrogenous material. Many other hydrocarbon plastics and other hydrogenous materials can be used for the continuous phase of the shielding materials of this invention. In fact, any solid hydrogenous material which satisfies the characteristics defined above and which can be manufactured to bond a discontinuous phase can be used for the shielding materials of this invention.

Many different materials can be used for the discontinuous phase of the shielding materials of this invention. One desirable characteristic of these discontinuous phase materials is that they will be available in the form of small particles or, alternatively, that they can readily be processed into a form of small particles. Henceforth, the material to be used as the discontinuous phase of the shielding materials of this invention will be referred to as the powder. As used herein, the term "powder" implies an ensemble of a large number of particles or grains. The powder can consist of particles of different sizes. The size of these particles can be in the range between zero and few centimeters. The preferable particle size depends on the process used for manufacturing the new materials of this invention. For illustration, for a casting manufacturing process it is preferable that at least 95% of the particles will pass an 18 mesh screen and that no more than 5% of the particles will pass a 325 mesh screen. Powders of two or more materials can be combined and used with the same hydrogenous bonding material to form a single shielding material. The desirable amounts of different powders to be used with a given hydrogenous material for a given shielding application can be determined by those skilled in the art using conventional computational methods.

One desirable characteristic of the powders to be used for the shielding materials of this invention is a high grain specific weight; the higher the grain density, the more effective it will be, per unit volume, in attenuating photon radiation. Another desirable characteristic of the powders is that they will have a high atomic density; the higher the atomic density, the larger becomes the probability that neutrons and photons will interact with the powder material per unit path length they traverse. An additional desirable characteristic of the powders is that they will have a high effectiveness in slowing down high energy neutrons via inelastic scattering. Still another desirable characteristic of the powders is that they will have a low probability for emitting energetic secondary photons as a result of neutron inelastic scattering and capture reactions. A related desirable characteristic is that the energy of the secondary photons they emit will be low. Those skilled in the art know how to evaluate and compare the nuclear characteristics identified above for any powder material to be considered.

The effectiveness of a material for inelastic scattering depends on the type of elements which constitute it via three characteristics: (a) The threshold energy for inelastic scattering. Neutrons with energies below this threshold have negligible probability for being inelastically scattered by the atoms of the element under consideration. (b) The probability that a neutron having energy above the threshold will undergo an inelastic scattering reaction per unit distance (for example, per centimeter) of travel in the material. (c) The average amount of energy lost by the neutron in an inelastic scattering reaction.

In general, the higher the atomic number of an element (i.e., the number of protons in the nucleus of the atom, denoted by "Z"), the better the element is as an inelastic scatterer. Thus tungsten ($Z=74$) and tantalum ($Z=73$) are known to be very good inelastic scatterers. Iron ($Z=26$) and other elements commonly used for structural materials, such as nickel ($Z=28$), chromium ($Z=27$), and manganese ($Z=25$), are known to be effective inelastic scatterers. On the other hand, low atomic number elements such as carbon ($Z=6$), oxygen ($Z=8$), sodium ($Z=11$), magnesium ($Z=12$), aluminum ($Z=13$), silicon ($Z=14$), and even calcium ($Z=20$), are known to be poor inelastic scatterers.

Table 1 compares, for illustration, the threshold energy and effective nonelastic scattering microscopic cross section of selected elements. A microscopic cross section is a measure of the probability for a specific reaction to occur when an atom of the element under consideration is exposed to a flux of neutrons (or incident particles) of a given energy. Nonelastic scattering reactions are those scattering reactions which are not elastic, that the neutron can undergo with the element atomic nuclei. They include inelastic scattering, (n,2 n) reactions (which produce two emitted neutrons as reaction products), and other such reactions. All of these reactions are effective in slowing down the energetic incident neutrons. Two effective cross sections are given in Table 1. The first corresponds to an average over the energy spectrum of fission-born neutrons. The other cross section corresponds to the more energetic fusion neutrons. All of the data in Table 1 is taken from Lawrence Livermore National Laboratory Report No. UCRL-50400, Vol. 16, Rev. 2, authored by E. F. Plechaty et al., published Oct. 31, 1978.

TABLE 1

Comparison of Nonelastic Scattering Characteristics of Selected Elements.

| Element | Atomic Number | Threshold Energy (MeV) | Effective Cross Section (barns) Fission | Fusion |
|---|---|---|---|---|
| Lithium | 3 | 0.5 | 0.19 | 0.48 |
| Carbon | 6 | 4.7 | 0.01 | 0.45 |
| Nitrogen | 7 | 2.3 | 0.008 | 0.41 |
| Oxygen | 8 | 6.4 | 0.006 | 0.56 |
| Fluorine | 9 | 0.1 | 1.21 | 0.86 |
| Sodium | 11 | 0.4 | 0.50 | 0.80 |
| Magnesium | 12 | 1.3 | 0.33 | 0.72 |
| Aluminum | 13 | 0.8 | 0.29 | 0.87 |
| Silicon | 14 | 1.2 | 0.22 | 0.51 |
| Sulfur | 16 | 2.3 | 0.13 | 0.57 |
| Chlorine | 17 | 0.8 | 0.27 | 0.87 |
| Potassium | 19 | 1.0 | 0.12 | 0.61 |
| Calcium | 20 | 1.2 | 0.08 | 0.84 |
| Titanium | 22 | 0.3 | 0.59 | 1.30 |
| Vanadium | 23 | 0.3 | 0.70 | 1.19 |
| Chromium | 24 | 0.5 | 0.53 | 1.01 |
| Manganese | 25 | 0.1 | 0.67 | 1.26 |
| Iron | 26 | 0.7 | 0.68 | 1.29 |
| Barium | 56 | 1.3 | 0.79 | 2.00 |
| Tantalum | 73 | 0.1 | 2.27 | 2.60 |
| Tungsten | 74 | 0.1 | 2.14 | 2.43 |
| Lead | 82 | 0.5 | 0.84 | 2.55 |

It is observed that the probability for inelastic scattering of fission and fusion neutrons by low Z elements is relatively small. There is a clear and significant increase in the inelastic scattering probability as the atomic number increases above Z=20 (i.e. starting from titanium). This is why structural materials such as iron and stainless steel, which have primarily constituents with Z greater than 20, are known to improve the ability of hydrogenous materials such as water or polyethylene to slow down energetic neutrons when added to these hydrogenous materials. On the other hand, the first 20 elements of the periodic table (up to and including calcium) are not being considered desirable additives to hydrogenous materials, for purposes of improving the ability of these materials to slow down energetic neutrons.

In addition to the physical and nuclear characteristics identified above, it is desirable that the powders to be used for the shielding materials of this invention will be environmentally benign and will not pose a health or safety hazard. Another desirable characteristic is that these powders will be chemically inert with the hydrogenous material to be used for the continuous phase. Yet another desirable characteristic of the powders is that they will have an acceptable amount of undesirable impurities. The acceptable amount of impurities can vary widely from application to application. Those skilled in the art know how to determine the maximum permissible level of different impurities for any specific application.

For many applications it is also very desirable that the powders to be used for the shielding materials of this invention will be of low cost. Certain abundant naturally occurring minerals are likely to satisfy this criterion better than non abundant minerals or than materials which require a significant investment in energy or manpower for their manufacture.

The number of materials that can adequately satisfy all or most of the desirable characteristics identified above is very large. These include, but are not limited to oxides, carbides, nitrides, chlorides, fluorides, sulfides, carbonates, sulfates, and tungstates. Also, most of the materials used as constituents of concretes, cements, mortars and grouts used for shields against nuclear radiation can be used for the medium density mateials of this invention. A list of these constituents can be found in many handbooks and reference books, such as in the above identified Engineering Compendium on Radiation Shielding.

Examples of naturally occurring and relatively abundant and inexpensive materials which can be used for the powder include, but are not limited to magnesium oxide (MgO), silicon dioxide ($SiO_2$), calcium carbonate ($CaCO_3$) and barium sulphate ($BaSO_4$). Examples of natural minerals not in use in concretes, cements, mortars and grouts which can be used in the shielding materials of this invention include, but are not limited to calcium fluoride ($CaF_2$), sodium fluoaluminate ($Na_3AlF_6$) and calcium tungstate ($CaWO_4$). Examples of man-made compounds and materials which can be used for the discontinuous phase of the shielding materials of this invention include, but are not limited to calcium oxide (CaO) and silicone carbide (SiC).

Table 2 compares the atomic density and specific weight of grains of selected powders. Given in the table are the nominal crystalline characteristics, as listed in the Handbook of Chemistry and Physics, 49$^{th}$ Edition, published by the Chemical Rubber Co., 18901 Cranwood Parkway, Cleveland, Ohio, 44128.

TABLE 2

Nominal Crystalline Atomic Density and Specific Weight of Selected Materials

| Material | Specific Weight ($g/cm^3$) | Atomic Density ($10^{22}$ atoms/$cm^3$) |
|---|---|---|
| MgO | 3.58 | 10.67 |
| $SiO_2$ (quartz) | 2.64 | 7.96 |
| $CaCO_3$ (aragonite) | 2.93 | 8.81 |
| $BaSO_4$ | 4.50 | 6.97 |
| $CaF_2$ | 3.18 | 7.36 |
| $Na_3AlF_6$ | 2.90 | 8.32 |
| $CaWO_4$ | 6.06 | 7.61 |
| SiC | 3.22 | 9.66 |

All of these materials are of a medium density. Henceforth, a "medium density material" refers to a material the specific weight of which is in the range between about 1 $g/cm^3$ and about 8 $g/cm^3$, and more likely in the range between about 2 $g/cm^3$ and about 6 $g/cm^3$.

The bonding of the discontinuous phase to the continuous phase of the shielding materials of this invention is achieved using any of the methods developed for incorporating lead or boron compound powder in polyethylene or another solid hydrogenous material. One of these methods involves melting the continuous phase material; adding to the melt the powder to make the discontinuous phase; mixing the powder with the molten material; pouring the mixture into molds; letting the mixture solidify; and, if desirable, cutting the resulting solid bodies into components that are convenient to handle. Another method is to properly mix a powder of the hydrogenous material intended for the continuous phase with the powder of the higher density material and to extrude the mixture into pellets. The pellets are than hot pressed to plates or other desirable shapes. Details of these processes are well known to those skilled in the art.

The volume fraction of the powder grains in the shielding materials of this invention ranges from about 10% to about 70%, and is preferably between 30% and 50%. The hydrogenous material occupies the remainder of the volume. Being castable, extrudable and machinable, the novel shielding materials can be manufactured in many different shapes and sizes. Their shapes may include, but is not limited to slabs, rods and bricks.

The discontinuous phase may consist of one or a combination of powders of different materials. In addition to powders of materials the primary function of which is to attenuate the photons and to help in slowing down the neutrons, it is possible to add one or several of the following types of powder: (1) Powders which include good neutron absorbing elements. Illustrations of such elements include, but are not limited to boron and lithium. (2) Powders which add hydrogen. Illustrations include, but are not limited to metal hydrides such as titanium hydride and lithium hydride, hydroxides and hydrates. (3) Powders which have a very high density and very effective inelastic scattering. An illustration includes, but is not limited to tungsten.

Neutron absorbing materials can be added to the shielding materials of this invention in two different ways. One way is to use a powder like boron carbide ($B_4C$), colmanite ($2CaO\ 3B_2O_3\ 5H_2O$) or of lithium carbonate ($LiCO_3$). Another way is to add the neutron absorbing material to the continuous phase. An example is to add boric oxide to the hydrogenous material, while in the molten state.

The number of combinations of the continuous and discontinuous phases in which the shielding materials of this invention can be made is very large. The most desirable combination of the type and volume fraction of the hydrogenous materials that make the continuous phase, and of the powders which are to make the discontinuous phase, is application dependent. This combination can be determined for each specific application by those skilled in the art using standard computer codes in use for shielding design and optimization.

Compared to previously known shielding materials, the shielding materials of this invention offer improved neutron attenuation, neutron shielding, and photon shielding ability. Tables 3, 4 and 5 compare the neutron and photon attenuation and shielding ability of selected new materials with those of typical shielding materials of the prior state-of-the-art. The new shielding materials consist of 50 volume percent powder bonded by polyethylene. The attenuation and shielding ability of the different materials is measured in terms of the radiation field established at the outer surface of a spherical shell, 80 centimeters in thickness, due to a radiation source located at a central spherical cavity, 1 centimeter in radius. Two types of radiation sources are considered: (1) A californium-252 spontaneous fission source. The neutrons it emits are fission neutrons; their average energy is about 2 MeV. In addition, it emits 3.2 photons per neutron. The detailed energy spectrum of the neutrons and photons emitted from the californium-252 source used for the calculations reported upon are those specified in the DABL69 cross-section library referenced below. (2) A fusion neutron source; it emits 14 MeV neutrons. Table 3 pertains to the photons only emitted from the californium source, Table 4 pertains to the total radiation (neutrons and photons) emitted from the californium source, whereas Table 5 pertains to the fusion neutron source.

The radiation field at the outer surface of the shield is characterized by four quantities: (1) The neutron dose rate—the contribution, to the dose-rate, of the neutrons which leak out from the shield; (2) The photon dose rate—the contribution, to the dose-rate, of the photons which leak out from the shield. These photons include both photons which originate from the source (in the case of the californium-252), and secondary photons; (3) The total dose rate—the sum of "1" and "2"; and (4) The fast neutron flux—the rate of leakage of neutrons the energy of which exceeds 1 MeV. Whereas quantities 1 through 3 measure the biological effect of the radiation leaking out from the shield, quantity 4 gives a measure of the shield effectiveness for the slowing down and attenuation of the high energy neutrons. All the quantities presented in Tables 3 and 4 are normalized to their value when the shield is made of pure polyethylene.

The reader should realize that the composition of the new shielding materials referred to in Tables 3 through 5 is not, necessarily, the optimal. The optimal powder volume fraction is application dependent; it can vary with the type of the radiation source, with the shield thickness, as well as with the type and amount of the neutron absorbing materials added to the shield. Therefore, the actual radiation attenuation and shielding ability of the new shielding materials of this invention are expected to be even better than that reported in Tables 3 through 5.

The results presented in Tables 3 through 5 were calculated using the radiation transport code ANISN with the nuclear data provided by the DABL69 library. Both ANISN and DABL69 are well known to those skilled in the art. They can be obtained from the Radiation Shielding Information Center of the Oak Ridge National Laboratory, Post Office Box 2008, Oak Ridge, Tenn., 37831-6362; telephone number (615) 574-6176; facsimile number (615) 574-6182. The distribution of neutron and photon energies from the californium source is that specified in the DABL69 library.

TABLE 3

Photon Dose Rate Emission From 80 cm Thick Spherical Shells Subjected to the Photons Emitted from a Central Cf-252 Spontaneous Fission Source.

| Shielding Material | Dose Rate (Relative to Pure Poly) |
|---|---|
| State-of-Art | |
| Pure Poly | 1.000 |
| 5% B-Poly | 0.967 |
| POLY/CAST | 0.506 |
| Pb-B-Poly | 0.00002 |
| Of this Invention | |
| $CaWO_4$/Poly | 0.0004 |
| $BaSO_4$/Poly | 0.0073 |
| MgO/Poly | 0.032 |
| SiC/Poly | 0.047 |
| $Ca_2F$/Poly | 0.051 |
| $CaCO_3$/Poly | 0.068 |
| $Na_3AlF_6$/Poly | 0.087 |
| $SiO_2$/Poly | 0.099 |

The new shielding materials of this invention are arranged in Table 3 in a descending order of their density; the lower its density, the further down is the material in the list. A clear correlation is observed between the photon attenuation ability of the material and the material density. The photon attenuation ability of the new materials of this invention can be orders of magnitude better than the photon attenuation ability of pure polyethylene (Pure Poly), of borated polyethylene (5% B-Poly) and even of POLY/CAST. As expected, lead loaded polyethylene (Pb-B-Poly) has an even better photon attenuation ability. However, it will shortly be shown that despite the superb and well known photon attenuation ability of lead, the neutron shielding ability of the lead loaded polyethylene is inferior to that of several of the new shielding materials of this invention.

The new shielding materials of this invention are arranged in Table 4 and in Table 5 in order of decreasing atomic density; the lower the material atomic density, the lower is the location of this material in the table. There exists no direct correlation between the atomic density of the material and its neutron attenuation ability. This phenomenon is expected in view of the differences in the effectiveness of the nuclei of different elements to slow down (and to capture) the neutrons. For example, $SiO_2$/Poly offers a worse neutron attenuation than its neighbors in Table 4 since Si is a less effective inelastic scatterer than W, F and Al which are among the constituents of the neighboring materials.

As expected from the results presented in Table 3 and the related discussion, Table 4 shows that all of the illustrative new materials of this invention offer a substantial reduction in the secondary photons contribution to the dose rate relative to pure and borated polyethylene, when exposed to a fission neutron source. Several of the new shielding materials of this invention reduce the secondary photon contribution to the dose rate even more than POLY/CAST.

Several of the new shielding materials of this invention illustrated in Table 4 offer a better attenuation of fission neutrons than even the best of the state-of-the-art neutron attenuators, such as pure polyethylene or POLY/CAST. This implies that the new shielding materials of this invention can not only significantly improve the photon attenuation ability over state-of-the-art hydrogenous shielding materials, but that this improvement can be obtained along with an improvement in the neutron attenuation ability relative to previously known shielding materials. It may be noted that the two measures of neutron attenuation ability considered in Table 4, shown in the first and fourth columns of the table, give the various materials a similar score.

TABLE 4

Radiation Field Emission From 80 cm Thick Spherical Shells Subjected to Fission Neutrons (No Primary Photons) Emitted from a Central Cf-252 Spontaneous Fission Source.

| Shielding Material | Dose Rate (Relative to Pure Poly) Neutrons | Photons | Total | >1 MeV Neutron Flux (Relative) |
|---|---|---|---|---|
| State-of-Art | | | | |
| Pure Poly | 1.000 | 1.000 | 1.000 | 1.000 |
| 5% B-Poly | 2.592 | 0.101 | 0.120 | 2.655 |
| POLY/CAST | 0.962 | 0.062 | 0.068 | 0.968 |
| Pb-B-Poly | 2.133 | 0.0001 | 0.016 | 2.161 |
| Of this Invention | | | | |
| MgO/Poly | 1.091 | 0.079 | 0.086 | 1.087 |
| SiC/Poly | 1.419 | 0.192 | 0.201 | 1.419 |
| $CaCO_3$/Poly | 2.512 | 0.233 | 0.250 | 2.537 |
| $Na_3AlF_6$/Poly | 1.371 | 0.312 | 0.320 | 1.376 |
| $SiO_2$/Poly | 3.900 | 0.196 | 0.211 | 3.725 |
| $CaWO_4$/Poly | 1.280 | 0.004 | 0.014 | 1.288 |
| $CaF_2$/Poly | 1.398 | 0.210 | 0.219 | 1.395 |
| $BaSO_4$/Poly | 2.231 | 0.035 | 0.051 | 2.254 |

It is also found that the shielding ability of several of the new shielding materials of this invention illustrated in Table 4 is better not only than the shielding ability of pure polyethylene, borated polyethylene and POLY/CAST, but also than of lead loaded borated polyethylene. It is anticipated that when adjusted to have the optimal combination of powders and the optimal powder to polyethylene ratio, the shielding ability of the new materials of this invention will be even higher than that reported in the third column of Table 4.

TABLE 5

Radiation Field Emission From 80 cm Thick Spherical Shells Subjected to a Central 14 MeV Fusion Neutron Source.

| Shielding Material | Dose Rate (Relative to Pure Poly) Neutrons | Photons | Total | >1 MeV Neutron Flux (Relative) |
|---|---|---|---|---|
| State-of-Art | | | | |
| Pure Poly | 1.000 | 1.000 | 1.000 | 1.000 |
| 5% B-Poly | 1.715 | 0.527 | 1.232 | 1.717 |
| POLY/CAST | 0.807 | 0.356 | 0.624 | 0.804 |
| Pb-B-Poly | 0.747 | 0.006 | 0.445 | 0.728 |
| Of this Invention | | | | |
| MgO/Poly | 0.300 | 0.175 | 0.249 | 0.296 |
| SiC/Poly | 0.486 | 0.292 | 0.407 | 0.478 |
| $CaCO_3$/Poly | 0.697 | 0.333 | 0.549 | 0.685 |
| $Na_3AlF_6$/Poly | 0.510 | 0.391 | 0.461 | 0.498 |
| $SiO_2$/Poly | 0.897 | 0.451 | 0.715 | 0.887 |
| $CaWO_4$/Poly | 0.398 | 0.029 | 0.248 | 0.386 |
| $CaF_2$/Poly | 0.558 | 0.251 | 0.433 | 0.542 |
| $BaSO_4$/Poly | 0.666 | 0.091 | 0.432 | 0.647 |

Table 5 reveals that the fusion neutron attenuation and shielding ability of the illustrative materials of this invention, relative to that of pure polyethylene, is entirely different from their ability to attenuate and shield fission neutrons (Table 4). All of the illustrative materials of this invention have a better fusion neutron attenuation ability than pure and borated polyethylene. Only one of the ten illustrative materials included in Table 5 ($SiO_2$/Poly) has a somewhat inferior fusion neutron attenuation ability than POLY/CAST and lead loaded borated polyethylene.

The fusion neutron attenuation ability (See columns 1 and 4 of Table 5) and shielding ability (See column 3 of Table 5) of most of the illustrative materials of this invention is better than the attenuation and shielding ability of even lead loaded borated polyethylene—the best performer of the conventional shielding materials. In short, the new materials of this invention provide improved shielding characteristics for both high and low energy incident neutron fluxes.

Prior to this invention, it was not known to those skilled in the art that by mixing certain medium density materials like the ones illustrated above, with certain hydrogenous materials like polyethylene, it is possible to obtain a better neutron attenuation ability and a better neutron shielding ability than that achievable with the state-of-the-art shielding materials.

In addition to the improvement in the neutron attenuation and neutron shielding ability they offer, the new shielding materials of this invention use environmentally benign materials which present less serious health hazards than lead-containing materials of the state-of-the-art. An additional advantage of the novel shielding materials of this invention relative to lead loaded hydrogenous materials is that they can be produced for a lower price. That is, the amount of the new material needed to provide a given shielding performance is significantly lower than the cost of that amount of leaded hydrogenous material needed for the same shielding performance. Indeed, certain of the novel shielding materials of this invention will cost even less than pure or borated polyethylene, while offering a better neutron and photon attenuation and shielding ability.

Relative to cemented plastics such as the POLY/-CAST, the powder loaded hydrogenous materials of this invention offer a number of advantages. One advantage is significantly greater flexibility in the selection of the medium density materials. Cemented plastics have to include a significant amount of medium density materials having adequate cementing properties. This imposes a constraint on the type and amount of medium density materials which can be included in the cemented plastics. No such constraint is imposed on the selection of the medium density materials for powder loaded hydrogenous materials. Hence, the selection of the medium density constituents for the powder loaded hydrogenous materials can be done so as to optimize the neutron attenuation or neutron shielding ability of these hydrogenous materials. For example, whereas a typical Portland cement used in many shielding materials consists of 63 weight percent (w/o) CaO, 23 w/o $Si_2O$ and only 2 w/o MgO, a shielding material of this invention may contain 100 w/o MgO powder bonded by polyethylene or another hydrogenous material. A related advantage of the shielding materials of this invention is that they can be selected to have smaller amounts of undesirable impurities than conventional cements or plasters.

Another advantage of the powder loaded hydrogenous materials of this invention is that the volume fraction of the hydrogenous material they contain can be larger than in state-of-the-art cemented plastics. This is because the volume fraction of the cementitious material of the cemented plastics must exceed a certain minimum value in order to provide acceptable binding and structural integrity. No such limitation exists on the minimum volume fraction of medium weight materials in the powder loaded hydrogenous materials of this invention. Thus, whereas the volume fraction of the cemented plastic which can be occupied by the plastic material can not be more than typically 60–70%, the volume fraction of the plastic material in the powder loaded hydrogenous materials of this invention can be selected to be anywhere in the range between about 30% and close to 100%. This flexibility enables one to better optimize the composition of the shielding materials of this invention to specific applications.

An additional advantage of the shielding materials of this invention is that the bonding is physical. In contrast, the state-of-the-art cemented plastics and concretes rely on chemical bonding. This chemical bonding is achieved by chemical reactions between the cementitious material and water which is added to it. As the amount of water contained by the cemented plastics and concretes can vary significantly from application to application, so do the neutron attenuation and shielding ability of these materials. The amount of water contained in cements, concretes and plasters depends on the casting process, on the treatment (watering) during a few days up to a few weeks following the casting, and on the temperature and humidity the shielding material is exposed to throughout its service. On the other hand, as the novel shielding materials of this invention are based on physical rather than chemical bonding, their hydrogen content can be well defined in the fabrication process, and can be maintained indefinitely. Hence, the shielding properties of these new materials are well defined throughout their life.

A related advantageous consequence of the physical bonding is that it provides the shield designer more flexibility in optimizing the shield composition to specific applications. One illustration is the ability to use highly hygroscopic materials without penalizing the shielding material performance. For example, whereas MgO cannot serve as a shield material by itself, embedded in a plastic material it can. The plastic material will form a barrier between the MgO grains and between humidity in the air or even water to which the shielding material could be exposed.

Another advantageous consequence of the physical bonding used for the fabrication of the shielding materials of this invention is that they can be reshaped more easily than cemented plasters or concretes. The process of reshaping of the powder loaded hydrogenous materials of this invention is, essentially, a repetition of the fabrication process of these materials. For example, reshaping can be accomplished by heating the component to be reshaped up to slightly above the melting temperature of the hydrogenous material, stirring the liquid to assure good homogeneity, and casting into molds for solidification into desirable shapes. This feature enables the owner of a shielding material of this invention to change the shape and/or composition of this material, if and when he finds it desirable to do so. The change in composition can be realized by adding to the molten material either additional powder of medium density material, or additional hydrogenous material. In addition, the powder loaded hydrogenous materials can be machined more readily than cemented plastics and concretes.

Still another advantage of the shielding materials of this invention is that they can operate at higher temperatures than cemented plastics. For example, in the above identified catalog of Reactor Experiments, Inc., the recommended temperature limit for POLY/CAST is 66° C., whereas the recommended temperature limits for polyethylene bonded materials is between 82° to 93° C. The use of hydrogenous material such as silicones and epoxys increases the acceptable operating temperature of powder loaded hydrogenous materials to the vicinity of 200° C. For comparison, in Volume II of the above identified Engineering Compendium on Radiation Shielding it is recommended that "Concretes used as neutron shields should not be exposed to constant temperatures over 93° C." The amount of hydrogen in concrete operating at 90° C. is only about half of its value at room temperature. In contrast, there will be practically no loss in the amount of hydrogen contained in the powder loaded hydrogenous materials up to the temperature at which the plastic material will have unacceptably low mechanical strength.

Yet another advantage of the shielding materials of this invention relative to cemented plastics such as POLY/CAST is that they are self supporting, can be used as stand-alone components and do not require a container or cladding. In addition, the shielding materials of this invention do not easily chip or crack. In contrast, POLY/CAST and the like state-of-the-art materials can easily chip, and have lower mechanical strength so that they require containers or well bounded volumes.

Based on the discussions and illustrations given above, it will be understood that the new powder loaded hydrogenous materials of this invention offer many useful advantages over the state-of-the-art shielding materials. Foremost of these advantages is the superior neutron attenuation and neutron shielding ability which was not previously known in the art. In addition, the new powder loaded hydrogenous materials of this invention offer one or a combination of the following practical advantages over state-of-the-art shielding materials: lower health hazard, lower cost, more stable composition, more versatile range of applications, and better reshaping ability.

In the preferred embodiment of the shielding materials of this invention described above, the bonding of the powder of the medium density material by the hydrogenous material is a physical bonding. In another embodiment of this invention, the bonding of the medium density powder is chemical. One family of chemically bonding hydrogenous materials is the silicone group. Another family of chemically bonding hydrogenous materials are the epoxys. In both silicone and epoxy type binders the hydrogen atomic density is significantly lower than that of hydrocarbon plastics (such as polyethylene), although it is possible to increase the hydrogen atomic density by bonding with silicone or with epoxy, a powder consisting of particles made of hydrocarbon plastic or another hydrogenous material mixed with particles of one or more medium density materials. In an additional but related embodiment of this invention, the mixed powder of hydrogenous and medium weight materials to be bonded by silicones or epoxys is made by grinding or shredding solid components of powder loaded hydrogenous materials, such as the materials described in the preferred embodiment of this invention.

In the preferred embodiment of this invention, the medium density material is to be in the form of particles. In another embodiment of this invention, the medium density materials to be bonded by the hydrogenous material are to be in the form of fibers. In addition to providing improved neutron and photon shielding ability, these fibers can increase the mechanical strength of the hydrogenous material above the strength it can have when the same amount of medium weight materials are in the form of particles. Examples of medium density materials which can be introduced in the form of fibers include, but are not limited to, $SiO_2$ and SiC.

In yet another embodiment of this invention, Portland cement, plaster of Paris or another cementitious material is used to bind particles made of powder loaded hydrogenous materials of the preferred embodiment of this invention of medium density materials. The particles to be bonded by the cementitious material can be made by grinding or shredding solid components of the powder loaded hydrogenous materials. This embodiment can be useful for applications where it is desirable to cast the shield in the field. The selection of the composition of the particles to be bonded by the cementitious material provides flexibility in setting the shielding properties of the cast shielding material.

Although the above description is illustrative of the principles of this invention, this description should not be construed as limiting the scope of the invention, but as merely providing illustrations of some of the presently preferred embodiments of this invention. In view of this disclosure, it will be apparent to those skilled in the art that a given medium density material can be bonded by different hydrogenous materials; that the medium density material can have a wide variety of grain sizes or combinations of them; that the medium density materials can occupy a fraction of the shielding material volume that can be varied; that two or more medium density materials can be combined and bonded by one hydrogenous material; that a neutron absorbing material can be one of the constituents of the powder loaded hydrogenous material; that the selection of the specific combination of hydrogenous material, medium density materials and neutron absorbing material which is optimal for a given shielding application can be determined by those skilled in the art using state-of-the-art shielding design computer codes; and that the novel shielding materials can be fabricated in different sizes and geometries. Accordingly, the scope of this invention should be determined not by the embodiments illustrated, but by the appended claims and their legal equivalents.

I claim:

1. A nuclear radiation shielding material comprising:

a first material having hydrogen atomic density which is at least one-third of that of water at standard temperature and pressure; and a second material having specific weight in the range between about 1 g/cm$^3$ and about 4 g/cm$^3$ mixed with said first material, wherein said second material is made of elements having an atomic number in the range between 1 and 20, which elements are not good neutron absorbers, said second material enhancing the properties of said first material for shielding against neutrons and photons.

2. The shielding material as in claim 1 wherein said second material is bonded by said first material.

3. The shielding material as in claim 2 wherein said second material is uniformly mixed with said first material.

4. The shielding material as in claim 2 wherein said second material occupies a volume fraction in the range between about 1% and about 70% of said shielding material volume.

5. The shielding material as in claim 4 wherein said second material occupies a volume fraction of about 30% to 50% of said shielding material volume.

6. The shielding material as in claim 1 wherein said second material is selected from the group consisting of oxides, carbides, nitrides, chlorides, fluorides, sulfides, carbonates, sulfates, and combinations thereof.

7. The shielding material as in claim 6 wherein said second material is selected from the group of compounds consisting of magnesium oxide, calcium oxide, silicon dioxide, silicon carbide, calcium fluoride, calcium carbonate, and combinations thereof.

8. The shielding material as in claim 1 wherein said first material is selected from the group consisting of hydrocarbons, hydrocarbon plastics, natural and synthetic rubber, and combinations thereof.

9. The shielding material as in claim 8 wherein said hydrocarbon plastic is polyethylene.

10. The shielding material according to claim 1, further comprising a third material mixed in said shielding material, wherein at least one element of said third material is a good neutron absorber.

11. The shielding material as in claim 10, wherein said at least one element is selected from the group consisting of boron, lithium and combinations thereof.

12. A nuclear radiation shielding material comprising a continuous phase of a cementitious material; and a discontinuous phase dispersed within said cementitious material, said discontinuous phase being in the form of particles comprising:

a first material having hydrogen atomic density which is at least one-third of that of water at standard temperature and pressure; and a second material having specific weight in the range between about 1 g/cm$^3$ and about 4 g/cm$^3$ mixed with said first material, wherein said second material is made of elements having an atomic number in the range between 1 and 20, which elements are not good neutron absorbers, said second material enhancing the properties of said first material for shielding against neutrons and photons, said particles having a size distribution such that no more than 10 percent of said particles have a size greater than one percent of the smallest dimension of said shielding material.

13. The shielding material as in claim 12, wherein said cementitious material is selected from the group consisting of portland cement, wall plaster, plaster of Paris, silica gel, clay and combinations thereof, set with water.

14. The shielding material as in claim 12, wherein said first material is selected from the group consisting of hydrocarbons, hydrocarbon plastics, natural and synthetic rubber, and combinations thereof.

15. The shielding material as in claim 12 wherein said second material is selected from the group consisting of oxides, carbides, nitrides, chlorides, fluorides, sulfides, carbonates, sulfates, and combinations thereof.

16. A method for attenuating nuclear radiation, comprising the step of intercepting said radiation with a shielding material formed of a continuous phase of a first material, said first material having hydrogen atomic density which is at least one-third of that of water at standard temperature and pressure, in which is dispersed a discontinuous phase of a second material, said second material having specific weight in the range between about 1 g/cm$^3$ and about 4 g/cm$^3$, wherein said second material is made of elements having an atomic number in the range between 1 and 20, which elements are not good neutron absorbers, said second material enhancing the properties of said first material for shielding against neutrons and photons, said first material occupying a volume between about 30 percent and 99 percent of the total shield volume.

17. The method as defined in claim 16, including a step of selecting said first material from the group consisting of hydrocarbons, hydrocarbon plastics, natural and synthetic rubber, and combinations thereof.

18. The method as defined in claim 17 including a step of selecting said hydrocarbon plastics from the group consisting of polyethylene, polypropylene, polystyrene and combinations thereof.

19. The method as defined in claim 16, including a step of selecting said second material from the group consisting of oxides, carbides, nitrides, chlorides, fluorides, sulfides, carbonates, sulfates, and combinations thereof.

20. The method as defined in claim 16, including a step of dispersing a third material in said shielding material.

21. The method as defined in claim 20, wherein said step of dispersing a third material includes the step of selecting a material from the group consisting of compounds having boron, lithium and combinations thereof as one element of the compound.

22. The method as defined in claim 20 wherein said step of dispersing a third material includes the step of selecting a material from the group consisting of a hydroxide, a hydrate, a metal hydrides and combinations thereof.

23. The method as defined in claim 20, wherein said step of dispersing a third material includes the step of selecting a material from the group consisting of tungsten, tantalum, lead and combinations thereof.

* * * * *